US006945039B2

(12) United States Patent
Yoshino

(10) Patent No.: US 6,945,039 B2
(45) Date of Patent: Sep. 20, 2005

(54) POWER SYSTEM AND WORK MACHINE USING SAME

(75) Inventor: Kazunori Yoshino, Kobe (JP)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/713,667

(22) Filed: Nov. 14, 2003

(65) Prior Publication Data

US 2005/0103007 A1 May 19, 2005

(51) Int. Cl.[7] ..... F15B 21/14
(52) U.S. Cl. ..... 60/414
(58) Field of Search ..... 60/414, 911; 290/50

(56) References Cited

U.S. PATENT DOCUMENTS

| | | | | |
|---|---|---|---|---|
| 3,512,072 | A * | 5/1970 | Karazija et al. | 60/911 |
| 3,641,416 | A * | 2/1972 | Riff | 290/50 |
| 3,947,744 | A * | 3/1976 | Grace et al. | 290/50 |
| 3,956,891 | A * | 5/1976 | Karazija | 60/414 |
| 4,702,076 | A * | 10/1987 | Rosman | 60/414 |
| 4,761,954 | A * | 8/1988 | Rosman | 60/414 |
| 4,961,316 | A * | 10/1990 | Corke et al. | 60/431 |
| 6,005,360 | A * | 12/1999 | Pace | 60/414 |
| 6,460,332 | B1 | 10/2002 | Maruta et al. | |
| 6,725,581 | B2 * | 4/2004 | Naruse et al. | 60/414 |

FOREIGN PATENT DOCUMENTS

| | | |
|---|---|---|
| DE | 2618046 | 11/1977 |
| DE | 2724383 | 11/1978 |
| DE | 4324464 A1 | 1/1995 |
| DE | 10128584 A1 | 12/2002 |
| JP | 2002-195218 | 7/2002 |

* cited by examiner

*Primary Examiner*—Thomas E. Lazo
(74) *Attorney, Agent, or Firm*—Liell & McNeil

(57) ABSTRACT

In the present invention, a power system includes at least one hydraulic cylinder that defines a first fluid volume and a second fluid volume separated from one another via a moveable plunger. Hydraulic power created within the hydraulic cylinder is converted to mechanical power by a fluid driven rotating device that is fluidly connected to at least the first fluid volume. A generator is attached to the fluid-driven rotating device, and produces electrical power that is stored in a power storage system including at least one of a battery and a capacitor. The stored electrical power can be supplied to an electric motor that is operable to power a hydraulic pump. The hydraulic pump supplies hydraulic fluid to the hydraulic cylinder. The power system of the present invention is a relatively inexpensive and efficient alternative to a power system including a diesel engine that can be a source of undesirable emissions, noise and vibrations.

19 Claims, 2 Drawing Sheets

POWER SYSTEM AND WORK MACHINE USING SAME

TECHNICAL FIELD

The present invention relates generally to power systems, and more specifically to a power system that is capable of recovering energy within a work machine.

BACKGROUND

Diesel engines are often used to power various types of work machines. Despite various improvements made over the years to the diesel engines, diesel engines still remain not only a source of vibration and noise, but also undesirable emissions, such as carbon dioxide ($CO_2$), nitrogen oxides ($NO_x$), unburned hydrocarbons and soot. All of these have been found to contribute to global warming and air pollution.

Over the years, engineers have attempted to decrease the use of diesel engines in order to decrease undesirable emissions, along with noise and vibrations. For instance, work machines often use a diesel engine to power a hydraulic pump that delivers hydraulic fluid to a hydraulic cylinder. Movement of a weight-driven plunger within the hydraulic cylinder drives the movement of the work machine's implement, such as a loader, excavator, or the like. When the plunger is retracting under the load of the weight, some of the hydraulic power created by the hydraulic fluid being pushed from a decreasing volume of the cylinder below the retracting plunger can be captured and re-used. The hydraulic fluid being pushed out of the cylinder can flow to an increasing volume within the cylinder above the retracting plunger. Thus, during retraction, some of the energy created by the hydraulic flow can be recovered, and the hydraulic fluid flow from the pump can be decreased, thereby also decreasing the diesel engine power required to operate the pump.

Due to an area of a rod that couples the plunger to the weight, the expanding volume above the retracting plunger within the cylinder is often smaller than the decreasing volume below the retracting plunger. Thus, during plunger retraction, more fluid is being pushed from the decreasing volume below the plunger than is needed to fill the increasing volume above the plunger. A throttle valve is used to bleed the excess hydraulic fluid flowing from the decreasing volume of the cylinder to a hydraulic fluid tank. Thus, only approximately half of the hydraulic fluid flowing from the decreasing volume below the plunger is delivered to the increasing volume above the plunger. Because of the significant amount of high pressure hydraulic flow being bled from the power system, the rate of energy recovery is too low to be efficient. In addition, the energy recovery only occurs when the plunger is retracting within the cylinder, thereby further reducing the efficiency of the energy recovery.

In order to increase the energy recovery, engineers have found methods of storing the captured energy from the pressurized hydraulic flow caused by plunger retraction. For instance, Patent Abstracts of Japan 2002-195218, which was published Jul. 10, 2002, shows that the excess flow of hydraulic fluid being bled to the fluid tank from the decreasing volume below the retracting plunger can also be used to operate a turbine that powers a generator. Electric current generated by the generator can be delivered to a water reservoir, in which electrolysis separates the water into hydrogen and oxygen. The hydrogen can be accumulated and stored in a hydrogen absorbing alloy cell. When needed, the hydrogen gas can be supplemented with hydrogen created in a reformer and delivered to a fuel cell, in which the hydrogen is re-combined with the oxygen to produce heated water and electric current. The electric current is delivered to an electric motor that powers the hydraulic pump. Thus, the diesel engine can be replaced with the electric motor ultimately driven partly by the recovered hydraulic power, thereby even further reducing undesirable emissions, noise, and vibrations, and increasing the efficiency of the energy recovery.

Although the electric motor powered by the fuel cell does decrease undesirable emissions, noise and vibrations, there is still room for improvement. Even with the use of the electric motor, the excess hydraulic flow from the decreasing volume of the cylinder to the fluid tank is throttled by the throttle valve prior to powering the turbine. Thus, some of the hydraulic power of the flow is wasted, rather than used to power the generator. Moreover, fuel cells, hydrogen absorbing alloys cells and reformers can be relatively expensive and problematic.

The present invention is directed to overcoming one or more of the problems set forth above.

SUMMARY OF THE INVENTION

In one aspect of the present invention, a power system includes an electric motor that is operable to power a hydraulic pump. At least one hydraulic cylinder is fluidly connected to the hydraulic pump. A first fluid volume and a second fluid volume defined by the hydraulic cylinder are separated from one another by a moveable plunger. A fluid driven rotating device, which is operable to power a generator, is fluidly connected to at least the first fluid volume of the hydraulic cylinder. The generator and the electric motor are in electrical communication with a power storage system that includes at least one of a battery and a capacitor.

In yet another aspect of the present invention, there is a method of operating a power system. Hydraulic power created within a hydraulic cylinder is converted to mechanical power in order to power a generator. Electrical power created by the generator is stored in at least one of a battery and a capacitor. The electrical power from at least one of the battery and capacitor is supplied to an electric motor coupled to a hydraulic pump in order to power the hydraulic pump. Hydraulic fluid is supplied to the hydraulic cylinder, at least in part, by operating the hydraulic pump.

DETAILED DESCRIPTION

Figure 1:
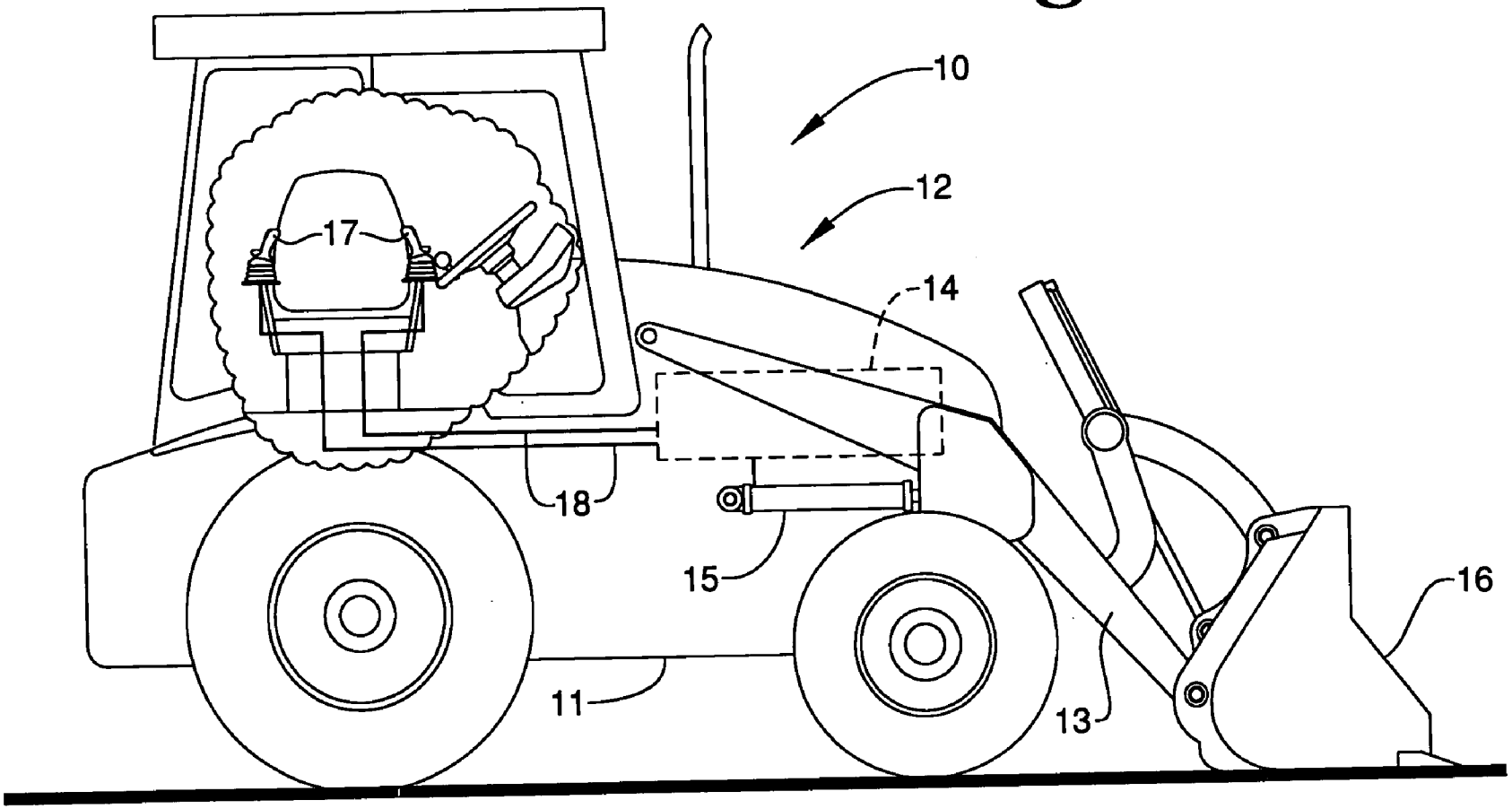
FIG. 1 is a side view of an example of a work machine, according to the present invention.

Referring to FIG. 1, there is shown a side view of a work machine 10. The work machine 10 includes a work machine body 111 to which an implement is attached. Although the work machine 10 is illustrated as a loader 12, it should be appreciated that the present invention is applicable to work machines including any type of hydraulically controlled implement. In addition, the present invention is applicable to work machines including more than one implement. Moreover, the present invention is applicable to power systems used to power apparatuses other than implements, and/or within vehicles other than construction work machines.

The loader 12 is controlled with implement controls 17. Although the work machine 10 includes the implement controls 17 being attached to an arm of the operator's seat, those skilled in the art will appreciate that the implement controls 17 can be positioned at any point within an operator's control station that is within the operator's reach. The implement controls 17 are preferably in electrical communication via implement communication lines 18 with a power system 14 attached to the work machine body 11. The power system 14 includes various valves (shown in FIG. 2) that control the flow of hydraulic fluid to and from a hydraulic cylinder 15. The loader 12 includes a bucket 16 operably coupled to move with the movement of a plunger 19 (shown in FIG. 2) within the hydraulic cylinder 15. In the illustrated example, hydraulic cylinder 15 is operable to move a pair of arms 13 of the loader 12 upwards and downwards in order to lift and lower the loader bucket 16. Although the work machine 10 is described for only one hydraulic cylinder 15, it should be appreciated that the present invention contemplates a power system including any number of hydraulic cylinders. For instance, the work machine 10 could include a second hydraulic cylinder that controls the movement of the loader bucket 16 about a horizontal axis.

Figure 2:
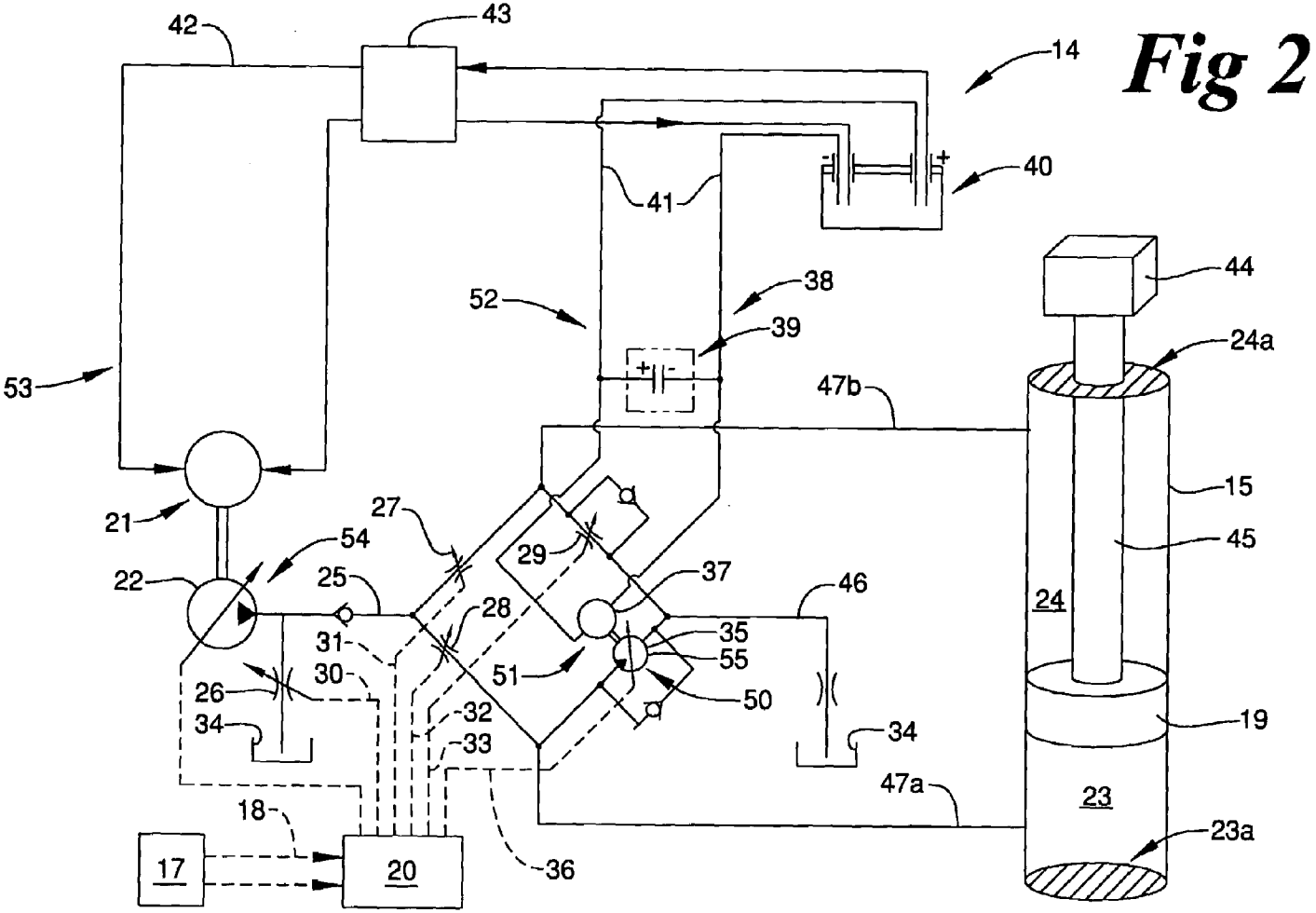
FIG. 2 is a schematic representation of a power system included within the work machine of FIG. 1.

Referring to FIG. 2, there is shown a schematic representation of the power system 14 within the work machine 10 of FIG. 1. The power system 14 includes a hydraulic pump 22 that is configured to be powered by an electric motor 21. The power system 14 includes means 54 for supplying hydraulic fluid, via the hydraulic pump 22, to the hydraulic cylinder 15. The hydraulic cylinder 15 is configured to receive hydraulic fluid from the hydraulic pump 22. The hydraulic pump 22 is fluidly connectable via a supply line 25 to a first fluid volume 23 and a second fluid volume 24 defined by the hydraulic cylinder 15. The first fluid volume 23 and the second fluid volume 24 are also fluidly connectable to a hydraulic fluid tank 34 via a tank line 46. The supply line 25 and the tank line 46 share common portions 47*a* and 47*b*. The first fluid volume 23 and the second fluid volume 24 are fluidly connectable to one another via the supply line 25 and the common portions 47*a* and 47*b*.

The moveable plunger 19 separates the first fluid volume 23 from the second fluid volume 24. A rod 45 couples the plunger 19 to a weight 44 (loader bucket 16) that is operable to drive the movement of the plunger 19 within the hydraulic cylinder 15. In order to lower the loader arms 13, the plunger 19 retracts under the weight 44, and in order to raise the loader arms 13, the plunger 19 advances against the weight 44. Those skilled in the art will recognize that the retraction rate can be hastened by supplying hydraulic fluid to second volume 24 by the hydraulic pump 22. The first fluid volume 23 is positioned on an opposite side of the plunger 19 than the weight 44, and the second fluid volume 24 is positioned on a same side of the plunger 19 as the weight 44. Due to the space consumed by the rod 45, as the plunger 19 retracts and advances, a cross-section 23*a* of the first fluid volume 23 will be greater than a cross-section 24*a* of the second fluid volume 24.

The supply line 25 includes first, second and third valves 26, 27 and 28, and the tank line 46 includes a fourth valve 29. The valves 26, 27, 28 and 29 control the flow to and from the hydraulic cylinder 15. The valves 26, 27, 28 and 29 are preferably in electrical communication with an electronic control module 20 via first, second, third and fourth valve communication lines 30, 31, 32 and 33, respectively. Further, the implement controls 17 are in communication with the electronic control module 20 via the control communication lines 18. Thus, the position of the implement controls 17 that corresponds to a desired position of the loader bucket 16 can be communicated to the electronic control module 20 via the implement communication lines 18. The electronic control module 20 can then determine the position of each valve 26, 27, 28, and 29 in order to create the hydraulic flow required to achieve the desired movement of the loader bucket 16. The controls may also be connected directly to the valves without departing from the present invention.

When the electronic control module 20 determines that the implement controls 17 are in a neutral position, the electronic control module 20 will ensure that valve 26 is in an open position, allowing any flow of hydraulic fluid from the hydraulic pump 22 to flow to a fluid tank 34. When the electronic control module 20, via the position of the implement controls 17, determines that the operator desires the loader bucket 16 to be raised, the electronic control module 24 will ensure that valve 26 is in a closed position and valve 28 is moved towards an open position. Thus, hydraulic fluid can flow from the hydraulic pump 22 via supply line 25 to the first fluid volume 23 of the hydraulic cylinder 15. The electronic control module 20 will also ensure that valve 27 is in a closed position, and valve 29 is in an open position, allowing hydraulic fluid from the second fluid volume 24 to flow to the fluid tank 34. Thus, the plunger 19 can advance against the weight 44, causing the loader bucket 16 to move upwards. When the electronic control module 20 determines that the operator desires the loader bucket 16 to be lowered, the electronic control module 20 can ensure that valve 26 and valve 29 are in the closed position and valves 27 and 28 are moved towards the open position, allowing hydraulic fluid to flow from both the hydraulic pump 22 and the first fluid volume 23 to the second fluid volume 24 of the hydraulic cylinder 15. Further, the hydraulic fluid can also flow from the second fluid volume 24 to the fluid tank 34 across valve 29. Thus, the plunger 19 can retract under the weight 44 and pump supplied hydraulic power, causing the loader bucket 16 to move downwards.

The power system 14 includes means 50 for converting hydraulic power produced within the hydraulic cylinder 15 to mechanical power. The means 50 includes a fluid driven rotating device 55, which preferably includes a variable displacement hydraulic motor 35. The variable displacement hydraulic motor 35 is configured to be powered by the hydraulic power produced within the hydraulic cylinder 15. The electronic control module 20 is also in communication with the variable displacement hydraulic motor 35 via a motor communication line 36. Although the fluid driven rotating device 55 is preferably the variable displacement hydraulic motor 35, it should be appreciated that various fluid driven rotating devices, such as a turbine, could be used. The variable displacement hydraulic motor 35 is fluidly positioned between the first fluid volume 23 of the hydraulic cylinder 15 and the tank line 46. Thus, as the plunger 19 retracts, the portion of the pressurized fluid flowing from the first fluid volume 23 towards the second volume of fluid 24 can be diverted and used to power the variable displacement hydraulic motor 35. When the electronic control module 20 determines, via the position of the implement controls 17, that the operator desires the loader bucket 16 to be lowered, the electronic control module 20 will vary the displacement of the variable displacement hydraulic motor 35 in order to achieve the desired retracting speed of the plunger 19, and thus, the desired lowering speed of the loader bucket 16 of the loader 12.

The power system 14 also includes means 51 for converting the mechanical power of the variable displacement hydraulic motor 35 to electrical power. The means 51 includes a generator 37 that is configured to be powered by the variable displacement hydraulic motor 35 and to supply electrical power to a battery 40 and/or a capacitor 39. The variable displacement hydraulic motor 35 is attached, in a conventional manner, to the generator 37. The rotation of the variable displacement hydraulic motor 35 powers the generator 37 that creates electrical power. The generator 37 is in electrical communication with a power storage system 38 via storage communication lines 41. The power system 14 includes means 52 for storing the electrical power in the battery 40 and capacitor 39. Although the power storage system 38 could include either the capacitor or the battery, the power storage system 38 preferably includes both the capacitor 39 including a relatively large storage capacity and the battery 40 including a relatively small storage capacity. The battery 40 and/or capacitor 39 can be periodically connected, when needed, to an external power source in order to be re-charged. The battery 40 and the capacitor 39 are configured to supply stored electrical power to the electric motor 21. Thus, the power system 14 includes means 53 for supplying the electric motor 21 coupled to the hydraulic pump 22 with the electrical power from the battery 40 and the capacitor 39. The battery 40 is in electrical communication with the electric motor 21 via an electrical supply line 42. Preferably, the means 53 includes an inverter 43 that is positioned within the electrical supply line 42 in order to invert DC electric current from the battery 40 to AC electric current for use within the electric motor 21.

INDUSTRIAL APPLICABILITY

Referring to FIGS. 1 and 2, the present invention will be described for the operation of the power system 14 included within work machine 10. Although the power system 14 drives the hydraulically activated loader 12, it should be appreciated that the present invention contemplates power systems that drive various work machine implements and/or auxiliary systems. Further, the present invention contemplates applications in machines and/or vehicles other than work machines.

In order to operate the power system 14, the hydraulic power created by the retracting plunger 19 is converted to mechanical power that drives the generator 37. When the operator moves the implement controls 17 to lower the loader bucket 16, the movement of the controls 17 will be communicated to the electronic control module 20 via the control communication lines 18. The electronic control module 20 will appropriately position valves 26, 27, 28 and 29 to lower the bucket 16, which can be accomplished in a number of ways. For instance, valve 28 could be closed and valve 27 opened such that second volume 24 is filled via supply line 25 from pump 22. Any excess fluid from pump 22 can be channeled back to tank 34 across valve 26. In a second alternative, valve 27 would be closed and volume 24 filled from tank 34 via a vacuum past the check valve located near valve 29. A third alternative could be some combination of the first and second alternatives. A fourth alternative could be to reduce pump 22's output to zero, and open valves 27 and 28 to fill volume 24 from volume 23. In any event, the first volume of fluid 23 is pressurized by the weight of the loader bucket 16, loader arms 13, and any load that is in loader bucket 16. All or at least a portion of the fluid displaced from first volume 23 can be channeled through variable displacement motor 35 on its way to tank 34. By varying the displacement of the variable displacement hydraulic motor 35, the electronic control module 20 will control the speed of the retraction of the plunger 19 in order to achieve the desired speed of the lowering of the loader bucket 16, The pressurized hydraulic fluid flowing through the variable displacement motor towards the tank line 46 to tank 34 will drive the variable displacement hydraulic motor 35. The rotation of the variable displacement hydraulic motor 35 powers the generator 37 that creates electrical power. It is recognized that if total power regeneration is not required, fluid from the first fluid chamber 23 can be controllably diverted across valve 28 to aid in filling the second fluid volume 24. Likewise, if too much fluid is being passed across the valve 28 to the second fluid volume 24, the valve 29 can be controllably opened to the tank 34 to avoid pressurizing the second fluid chamber 24.

In order to store the electrical power created by the generator 37, the electric current is delivered from the generator 37 to the capacitor 39 via the storage communication lines 41. The capacitor 39 is designed to have a larger storage capacity than the battery 40. Thus, the capacitor 39 can store the electric current which cannot be stored within the battery 40. When the electric power stored within the battery 40 falls below a predetermined amount, the capacitor 39 can replenish the electric power within the battery 40. Therefore, the hydraulic power created by the retracting plunger 19 can be stored as electric power within the battery 40 and capacitor 39 until the power is needed.

In order to power the hydraulic pump 22, the electric current stored within the battery 40 is supplied to the electric motor 21 via the electric current supply lines 42. However, because electric motor 21 generally operates on AC current and the current produced by the generator 37 is generally DC current, the inverter 43 will preferably invert the DC current from the battery 40 to AC current to power the electric motor 21. It should be appreciated that the present invention contemplates power systems in which an inverter is not necessary. The current supplied to the electric motor 21 will drive the motor 21 to operate the hydraulic pump 22. The hydraulic pump 22 can then supply hydraulic fluid via the supply line 25 to the first fluid volume 23 during the advancement of the plunger 19 within the cylinder 15. The hydraulic pump 22 can also supply hydraulic fluid to the second fluid volume 24 via the supply line 25 when the plunger 19 is retracting. During plunger 19 retraction, the hydraulic fluid being produced by the hydraulic pump 22 will keep second fluid volume 24 full and the remainder of the fluid is bypassed to the tank 34 across valve 26. The excess portion of the pressurized hydraulic fluid flowing from the first fluid volume 23 to the fluid tank 34 during retraction drives the variable displacement hydraulic motor 35, and the energy recovery process can repeat itself. The energy recovered supplements the energy needed to be delivered from external sources to, and stored within, the battery 40 and the capacitor 39. Thus, the time period between charging the battery 40 and/or the capacitor 39 may be shortened, and the time between external chargings lengthened.

The present invention is advantageous because the power system 14 including the battery 40, the capacitor 39 and the variable displacement hydraulic motor 35 is a relatively inexpensive and efficient alternative to the diesel engine. By removing the diesel engine from the power system, undesirable emissions, such as $CO_2$ and $NO_x$, which are major factors in global warming and air pollution, are reduced, if not eliminated. Further, the noise and vibrations produced by the power system 14 are also reduced. Moreover, by directing the flow of hydraulic fluid from the first fluid volume 23 during plunger 19 retraction through the variable displacement hydraulic motor 35, the power system 14 can be powered by an unthrottled hydraulic flow passing therethrough towards the tank line 46. Thus, by replacing a throttle valve that regulates the flow of fluid from the larger cross-section 23*a* of the first fluid volume 23 during plunger 19 retraction with the variable displacement motor 35, the efficiency of the power system 14 is increased.

In addition, because the power system 14 includes the storage power system 38, the hydraulic power can be stored as electrical power for prolonged use within the power system 14. The stored electrical power can be used to drive the electric motor 21, which in return can drive the hydraulic pump 22. Moreover, the present invention contemplates the stored energy being used to power additional electric apparatuses that are part of systems other than the hydraulic implement system. For instance, the electric motor could power a coolant pump that is part of a coolant system of the same work machine. Thus, there may be various uses for the energy stored by the power system 14. Further, the battery 40 and capacitor 39 are relatively inexpensive compared to power storage systems including fuel cells, hydrogen absorbing alloy cells, and reformers.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A power system comprising:

an electric motor being operable to power a hydraulic pump;

at least one hydraulic cylinder being fluidly connected to the hydraulic pump and defining a first fluid volume and a second fluid volume separated from one another via a moveable plunger;

a fluid driven rotating device being fluidly connected between the first fluid volume and the second fluid volume defined by the hydraulic cylinder and being operable to power a generator; and a power storage system including at least one of a battery and a capacitor being in electrical communication with the generator and the electric motor.

2. The power system of claim 1 including an inverter being positioned between the electric motor and at least one of the capacitor and battery.

3. The power system of claim 1 wherein the fluid driven rotating device includes a variable displacement hydraulic motor.

4. The power system of claim 3 including an inverter being positioned between the electric motor and at least one of the capacitor and the battery.

5. A work machine comprising a work machine body; and the power system of claim 1 being attached to the work machine body.

6. The work machine of claim 5 including an implement attached to the work machine body; and the at least one hydraulic cylinder being operably coupled to move the implement.

7. The power system of claim 1 further comprising at least one adjustable valve disposed between the first volume and the second volume to selectively fluidly connect the same.

8. A power system, comprising:

means for supplying a pressurized hydraulic fluid to at least one hydraulic cylinder;

means for converting hydraulic power produced within said at least one hydraulic cylinder to mechanical power at least in part via a fluid driven rotating device;

said fluid driven rotating device being disposed at least partially within a fluid passage connecting said means for supplying with said at least one hydraulic cylinder;

means for converting the mechanical power to electrical power;

means for storing the electrical power in at least one of a battery and a capacitor;

means for supplying an electric motor coupled to the hydraulic pump with the electrical power from at least one of the battery and the capacitor; and means for supplying hydraulic fluid, via the hydraulic pump, to the at least one hydraulic cylinder.

9. The power system of claim 8 wherein the means for converting hydraulic power to mechanical power includes a variable displacement hydraulic motor.

10. The power system of claim 8 wherein means for supplying the electrical power includes an inverter.

11. The power system of claim 8 wherein the at least one hydraulic cylinder being operably coupled to move a work machine implement.

12. A method of operating an electrical power system, comprising the steps of:

powering a generator, at least in part, by converting at least a portion of hydraulic power created within a hydraulic cylinder to mechanical power via a fluid driven rotating device fluidly positioned between a first volume and a second volume of the hydraulic cylinder;

storing electrical power created by the generator in at least one of a battery and a capacitor;

powering a hydraulic pump, at least in part, by supplying electrical power from at least one of the battery and capacitor to an electric motor coupled to the hydraulic pump; and supplying hydraulic fluid to the hydraulic cylinder, at least in part, by operating the hydraulic pump.

13. The method of claim 12 wherein the step of powering the generator includes a step of attaching a variable displacement hydraulic motor to the generator.

14. The method of claim 12 wherein the step of powering the generator includes a step of producing hydraulic power by retracting a plunger within a hydraulic cylinder.

15. The method of claim 14 wherein the step of producing hydraulic power includes a step of controlling a speed of the retracting plunger, at least in part, by varying the displacement of the motor.

16. The method of claim 12 wherein the step of powering a hydraulic pump includes a step of inverting electrical current being supplied from at least one of the capacitor and the battery to the electric motor.

17. A power system comprising:

at least one of a battery and a capacitor being configured to supply stored electrical power to an electric motor;

a hydraulic pump being configured to be powered by the electric motor;

a hydraulic cylinder being configured to receive hydraulic fluid from the hydraulic pump said hydraulic cylinder defining first and second fluid volumes;

a fluid driven rotating device being configured to be powered by hydraulic power produced within the hydraulic cylinder;

said fluid driven rotating device being positioned within a fluid pathway connecting said first and second volumes, wherein said fluid pathway includes at least two adjustable valves disposed in parallel; and a generator being configured to be powered by the fluid driven rotating device and to supply electrical power to at least one of the battery and the capacitor.

18. The power system of claim 17 including an inverter configured to invert the electrical power being supplied from the at least one battery and capacitor to the electric motor.

19. The power system of claim 17 wherein the fluid driven rotating device includes a variable displacement hydraulic motor.

* * * * *